United States Patent [19]

Stearns

[11] 3,972,202

[45] Aug. 3, 1976

[54] CLOSED LOOP CRYOGENIC DELIVERY

[75] Inventor: Thornton Stearns, Winchester, Mass.

[73] Assignee: Vacuum Barrier Corporation, Woburn, Mass.

[22] Filed: Aug. 23, 1974

[21] Appl. No.: 499,833

[52] U.S. Cl. ..... 62/55; 62/197; 62/512; 62/514 R

[51] Int. Cl.[2] ..... F17C 7/02

[58] Field of Search ..... 62/197, 512, 514, 45, 62/55

[56] References Cited

UNITED STATES PATENTS

| | | | |
|---|---|---|---|
| 2,270,934 | 1/1942 | Dickieson, Jr. | 62/197 |
| 3,025,680 | 3/1962 | De Brosse et al. | 62/514 X |
| 3,697,021 | 10/1972 | Howard | 62/45 X |

*Primary Examiner*—William F. O'Dea
*Assistant Examiner*—Ronald C. Capossela

[57] ABSTRACT

Apparatus for delivering cryogenic liquid to a heat exchanger wherein said liquid is vaporized for its cooling effect comprising a return conduit for conveying from a heat exchanger to a separator vessel spent fluid including some vapor, the return conduit discharging at its upper end into the portion of the vessel holding vapor, a return port for receiving spent fluid from an exchanger, a bypass passage constricted at its upper end providing a flow path in parallel with flow through an exchanger from a feed junction to a more elevated return junction, the flow being conducted in an upwards direction to the feed junction and from the feed junction into the bypass passage, the apparatus providing closed loop circulation of cryogenic liquid to a heat exchanger, with the driving force for the circulation being supplied by the differential head between cryogenic liquid in the feed conduit and spent fluid in the return conduit.

10 Claims, 4 Drawing Figures

CLOSED LOOP CRYOGENIC DELIVERY

BACKGROUND OF THE INVENTION

This invention relates to apparatus for delivering cryogenic liquid to a heat exchanger where said liquid is vaporized for its cooling effect.

Systems for supplying cryogenic liquid for cooling various pieces of apparatus from a central reservoir have often been susceptable to surges and other irregularities in delivery of the coolant resulting in inconvenient and inefficient operation. These systems have also often been unsatisfactory when used to supply apparatus which is shut down for a period of time, since during such periods of shut down the delivery apparatus becomes filled with vapor so that delays and irregular operation are encountered when the equipment to be cooled is again put in operation.

SUMMARY OF THE INVENTION

The invention features apparatus for delivering cryogenic liquid to a heat exchanger wherein said liquid is vaporized for its cooling effect comprising a return conduit for conveying from a heat exchanger to a separator vessel spent fluid including some vapor, a return port for receiving spent fluid from an exchanger, the return port being connected to discharge spent fluid into the lower end of the return conduit, the apparatus providing closed loop circulation of cryogenic liquid to a heat exchanger, with the driving force for the circulation being supplied by the differential head between cryogenic liquid in the feed conduit and spent fluid in the return conduit. Embodiments of the invention include a return conduit discharging into the portion of the separator vessel holding vapor, a bypass passage constricted at its upper end providing a flow path in parallel with flow through an exchanger from a feed junction to a more elevated return junction, the flow being conducted in an upwards direction to the feed junction and from the feed junction into the bypass passage.

DESCRIPTION OF THE PREFERRED EMBODIMENT

Figure 1:
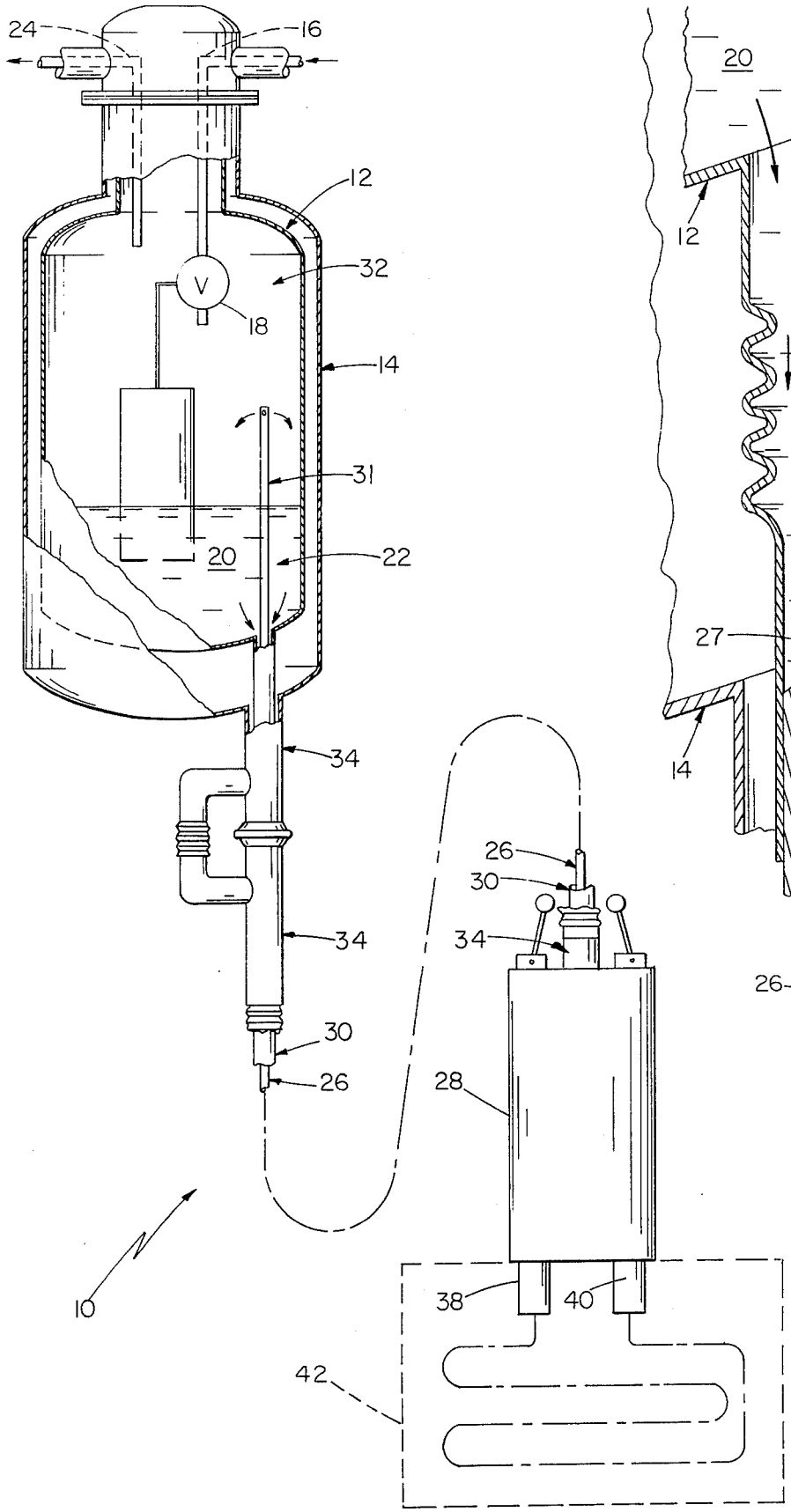
FIG. 1 shows the overall view of apparatus for delivering cryogenic liquid to a heat exchanger, some portions thereof being cut away to reveal internal details.
Figure 2:
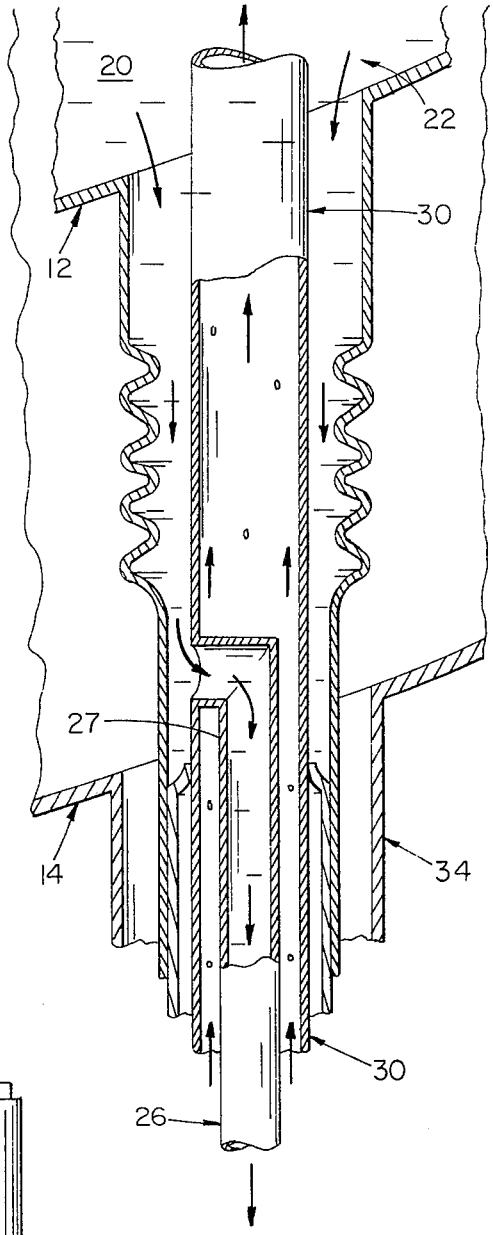
FIG. 2 shows in section a portion of the separator vessel of FIG. 1 and the connections of the conduits connected thereto.

Delivery apparatus according to the invention and designated generally by numeral 10 includes separator vessel 12 enclosed in vacuum jacket 14 and supplied by cryogenic fluid, which is typically liquid nitrogen, through conduit 16 emptying into vessel 12 through automatically controlled valve 18. Cryogenic liquid 20 is maintained in the lower portion 22 of vessel 12 and the vapor therefrom occupies upper portion 32 of vessel 12 and is vented through vent 24. Feed conduit 26 at its upper end 27 draws liquid from separator vessel 12 and connects at its lower end 29 to delivery fitting

28. Return conduit 30, shaped as an annular passage coaxial with feed conduit 26, connects at its upper end 31 with vapor space 32 above fluid 20 and at its lower end 33 to lower fitting 28. An outer concentric tube 34 provides a vacuum jacket for insulation of the feed and return conduits from ambient temperatures. Delivery fitting 28 is positioned at a lower elevation than separator vessel 12 and the feed and return conduits are advantageously arranged to have an uninterrupted downward slope from separator vessel 12 to delivery fitting 28. Delivery fitting 28 terminates in delivery port 38 and return port 40, exchanger 42 being connected to receive cryogenic fluid from delivery port 38 and discharge spent fluid to return port 40.

Figure 3:
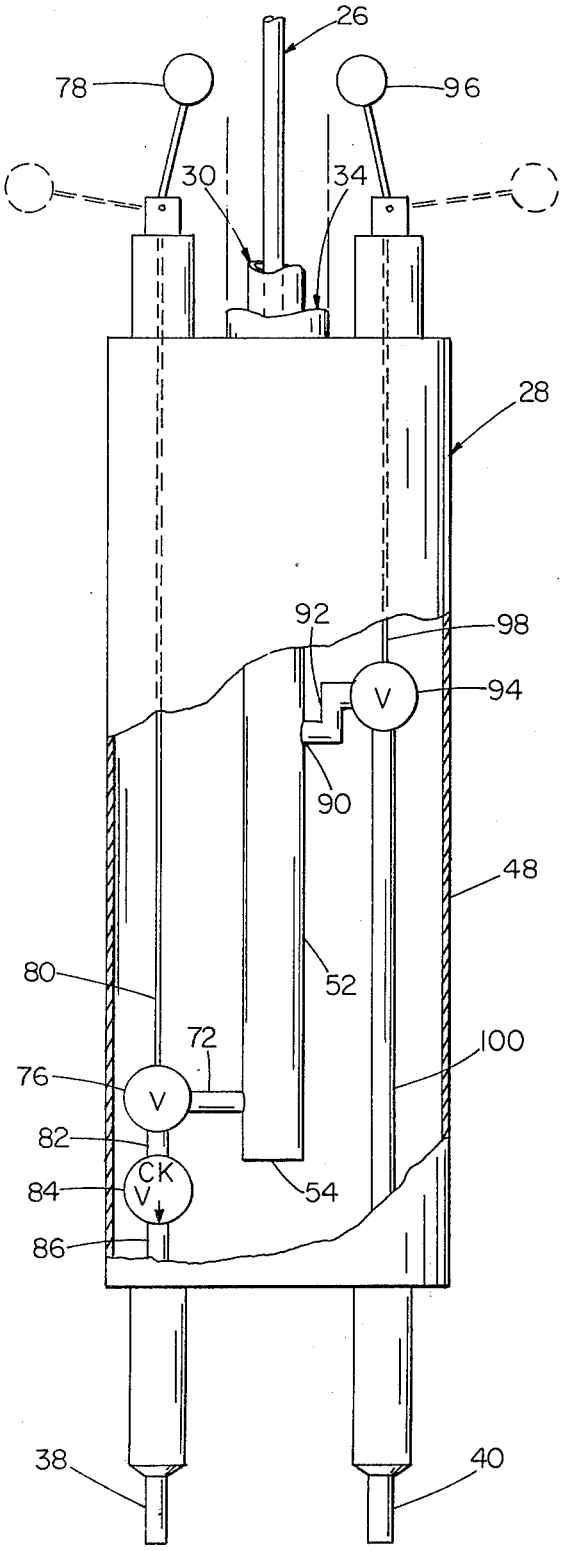
FIG. 3 shows a delivery fitting of the system of FIG. 1 with portions of the outer enclosure cut away to reveal internal details.
Figure 4:
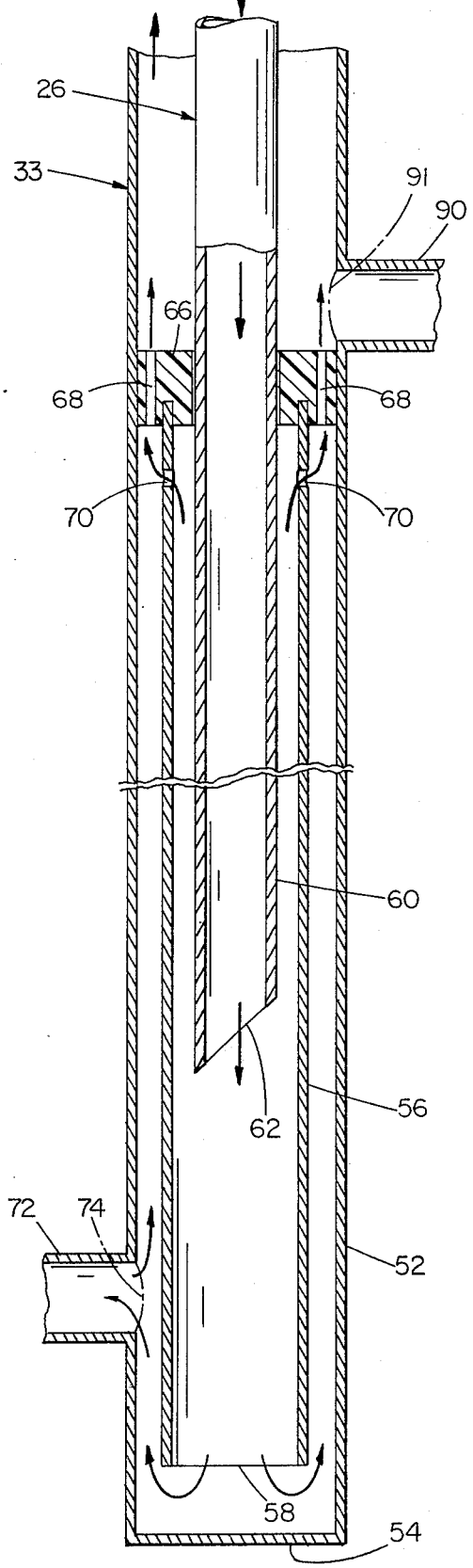
FIG. 4 shows an enlarged view of the construction within the delivery fitting shown in FIG. 3.

Referring particularly to FIGS. 3 and 4, showing details of the delivery fitting, there are inside vacuum wall 48 three generally concentric tubes. Outer tube 52 extends to near the bottom of delivery fitting 28. It has a closed bottom 54 and confines the cryogenic fluid. Inner tube 60 provides an extension of feed conduit 26 and lies within tube 56 having an open bottom 62 positioned above the bottom 54 of tube 52. Intermediate tube 56, terminating in open end 58, provides a further extension of feed conduit 26. It is positioned intermediate to tubes 52 and 60. Passages 70 penetrate the wall of tube 56 near its upper end. Tube 72 opens at one end into the wall of tube 52 at feed junction 74, which is above bottom 58 of tube 56. Tube 72 connects at its other end to control valve 76 operated by control handle 78 through long valve stem 80. Tube 82 connects valve 76 to check valve 84, and tube 86 connects check valve 84 to delivery port 38. Tube 90 opens at one end into the wall of outer tube 52 at return junction 91, which is positioned at a higher elevation than junction 74, and connects at its other end to valve 94 which is controlled by lever 96 through stem 98. Tube 90 has an upward running portion 92 between junction 91 and valve 94. Tube 100 connects on one end to valve 94 at its other end to return port 40.

It can be readily seen that the structure described provides a closed loop path for circulation of cryogenic fluid from vessel 12, through conduit 26 and its extensions in tubes 60 and 56 to junction 74; then through tube 72, valve 76, tube 82, check valve 84, tube 86, and port 38 to heat exchanger 42; then from exchanger 42, through port 40, tube 100, valve 94, and tube 90 to junction 91; then through conduit 30 back to vessel 12. The structure also provides a bypass passage from feed junction 74 to return junction 91 running in parallel to the path through exchanger 42; namely, from junction 74 through the annular space between tubes 52 and 56 and through passages 68 to junction 91.

The operation of the cryogenic supply system described above will first be considered for the situation when the heat exchanger is connected to the delivery and return ports and has been in operation for sufficient time for a steady flow pattern to be established. Cryogenic fluid is delivered at some elevated pressure through conduit 16 and is throttled through valve 18 to atmospheric pressure as it enters separator vessel 12. Valve 18 automatically controls the admission of cryogenic fluid to maintain liquid in the bottom portion of vessel 12 and a vapor space in the upper portion of vessel 12. Excess vapor is vented through vent pipe 24. Cryogenic liquid is drawn from the bottom portion of separator vessel 12 passing along a downward slope in feed conduit 26 to delivery fitting 28, which it enters through tube 60. Cryogenic liquid is discharged from the bottom of tube 60 into tube 56, which discharges the fluid into tube 52 near its closed bottom. The fluid then flows upward in the annular space between tubes 56 and 52 to feed junction 74 and then passes through tube 72, valve 76, tube 82, check valve 84, tube 86 and delivery port 38 to enter exchanger 42, connected to delivery port 38. Cryogenic fluid passes through exchanger 42 and is in part vaporized there to provide cooling effect in the heat exchanger. The spent fluid from the heat exchanger 42, now containing a mixture of liquid and vapor, is discharged into return port 40 and passes through tube 100, valve 94 and tube 90 to return junction 91. The spent fluid then passes through the annular space inside of return conduit 30 back to separator vessel 12 where it is discharged into the vapor space above the cryogenic liquid occupying the bottom portion of vessel 12. Discharging the spent fluid into the vapor space prevents vapor bubbles in the liquid volume and so assures that no bubbles will be sucked into the feed conduit. The differential head between the completely liquid material in feed conduit 26 and the lower density mixture of liquid and vapor in the return conduit provides a driving force for the circulation as described through the heat exchanger. The delivery apparatus is advantageously self-regulating because when greater cooling effect is drawn from the heat exchanger more vaporization occurs, producing a larger vapor fraction in the return conduit and therefore a larger driving force for the circulation through the exchanger. The closed loop system has further advantages in that the steady motion of the cryogenic fluid through the exchanger produces a high wall heat transfer coefficient and uniform cooling free of surges and irregularities which, in open end systems, may introduce loss of cryogenic liquid and other inefficiencies of operation. During the steady operation as described above, there is a bypass flow from feed junction 74 through the annular space between tubes 52 and 56 and passage 68 to return junction 91 which occurs as a result of the lower pressure at return junction 91 than at feed junction 74. The bypass flow is, however, small compared to that circulating through the heat exchanger because the cross section of passage 68 is small compared to the cross section for flow through the heat exchanger or through the feed conduit. The small bypass flow is advantageous in providing a cold jacket around the feed stream passing through tubes 60 and 56.

Turning now to the operation of the system during shut down and start up, the normal method for closing down the heat exchanger is by closing valve 76. With the flow of cryogenic liquid closed off, heat will penetrate into the heat exchanger and its connections over a period of time so that eventually all the liquid will be vaporized in the heat exchanger and in the tubing and connections between tube 72 and tube 90. A certain amount of heat will also continue to leak through the outer tube 52 and the outer wall of return conduit 30 and will cause vaporization of the fluid interior to those walls at a small rate. Because of this vaporization, the fluid in the return conduit will continue to have a lower density than that in the feed conduit and there will continue to be a differential head resulting therefrom. This differential head drives a small flow of fluid from feed junction 74 through the bypass passage in the annulus between tubes 52 and 56 and through passage 68 to the return junction, so that a low level of circulation is maintained through the feed conduit, the bypass passage, and the return conduit. This flow provides continuous cooling effect in the passages where it flows so that passages do not become filled with vapor.

It may be especially noted that the flow path for the cryogenic liquid approaches the feed junction from below. This arrangement assures that vapor produced in tube 72 or at the outer wall of tube 52 rises into the annular space between tubes 52 and 56 enters the return conduit rather than entering the feed conduit where it might have the undesired effect of reversing the desired flow direction. The structure described provides a further safe-guard against the entry of vapor into the feed conduit in providing an annular space between tubes 56 and 60 so that any vapor formed here will be discharged through passages 70 and into the return conduit.

When it is desired to start up the heat exchanger, valve 76 is opened. Because initially the bypass passage is filled with liquid while the passage through the heat exchanger is filled with vapor and because feed junction 74 is below return junction 91, there is a fluid head driving circulation from feed junction 74 through the heat exchanger to return junction 91 resulting in starting the flow through the heat exchanger in the desired direction. Check valve 84 prevents any surges from rapid boiling in the heat exchanger from reversing this flow. The constriction in the bypass passage assures that the initial flow from the heat exchanger will continue up into return conduit 30 rather than initiating a local circuit backwards through the bypass. As the vapor from the heat exchanger enters into return conduit 30, the density of fluid in the return conduit is reduced and the drive force is established for the steady circulation of cryogenic fluid as previously described. The delivery system described provides quick start-up because cryogenic liquid is maintained in the ducting as far as the junctions so that only a short section of warm tubing must be flooded to get the exchanger into operation.

Various modifications of the above described embodiment will be obvious to those skilled in the art and are within the scope of the following claims.

I claim:

1. Apparatus for delivering cryogenic liquid to a heat exchanger wherein said liquid is vaporized for its cooling effect said apparatus having a separator vessel for holding cryogenic liquid in its lower portion and the vapor of said liquid in its upper portion, said vessel being positioned higher than said exchanger and having a vent for discharge of vapor, a feed conduit with an upper and a lower end for conveying cryogenic liquid from said vessel to an exchanger, said feed conduit being connected at its upper end to said vessel to draw cryogenic liquid from the lower portion thereof, and a delivery port for discharging cryogenic liquid to an exchanger, said delivery port being connected to receive cryogenic liquid from the lower end of said feed conduit, comprising a return conduit with an upper and a lower end for conveying from an exchanger to said separator vessel spent fluid including some vapor, said return conduit connected to discharge at its upper end into the same said vessel from which said liquid is withdrawn by said feed conduit at the pressure of the withdrawn liquid, a return port for receiving spent fluid from an exchanger, said return port being connected to discharge said spent fluid into the lower end of said return conduit, said apparatus arranged and connected to provide, when connected to a heat exchanger, an uninterrupted closed loop delivery path from said vessel successively through said feed conduit, said delivery port, said exchanger, said return port, and said return conduit, back to said vessel, in which path circulation of cryogenic liquid is driven by a differential gravity head between cryogenic liquid in said feed conduit and spent fluid in said return conduit.

2. Apparatus as claimed in claim 1, said return conduit discharging into the portion of said vessel containing vapor.

3. Apparatus for delivering cryogenic liquid to a heat exchanger wherein said liquid is vaporized for its cooling effect said apparatus having a separator vessel for holding cryogenic liquid in its lower portion and the vapor of said liquid in its upper portion, said vessel being positioned higher than said exchanger and having a vent for discharge of vapor, a feed conduit with an upper and a lower end for conveying cryogenic liquid from said vessel to an exchanger, said feed conduit being connected at its upper end to said vessel to draw cryogenic liquid from the lower portion thereof, and a delivery port for discharging cryogenic liquid to an exchanger, said delivery port being connected to receive cryogenic liquid from the lower end of said feed conduit, comprising a return conduit with an upper and a lower end for conveying from an exchanger to said separator vessel spent fluid including some vapor, said return conduit discharging at its upper end into said vessel a return port for receiving spent fluid from an exchanger, said return port being connected to discharge said spent fluid into the lower end of said return conduit, said apparatus providing closed loop circulation of cryogenic liquid to a heat exchanger connected to said ports, the driving force for said circulation being supplied by the differential gravity head between cryogenic liquid in said feed conduit and spent fluid in said return conduit said apparatus including a bypass passage communicating between a feed junction where flow from said feed conduit divides between said passage and an exchanger connected to said ports to a return junction where flow from said passage and a connected exchanger rejoin, said passage providing for flow between said junctions in parallel with that through an exchanger connected to said ports.

4. Apparatus as claimed in claim 3, said return junction being at a higher elevation than said feed junction.

5. Apparatus as claimed in claim 4, said bypass passage being constricted in comparison to said feed conduit.

6. Apparatus as claimed in claim 5, said bypass passage being constricted at its upper end.

7. Apparatus as claimed in claim 4, said feed conduit conducting flow to said feed junction from below and said bypass passage conducting flow away from said feed junction from above so that vapor entering said feed junction from said delivery port will rise into said by-pass passage.

8. Apparatus as claimed in claim 4, including a delivery fitting connected to said conduits and having an outer tube which has a closed bottom and confines the cryogenic fluid, and interior thereto a second tube with an open bottom, said second tube being positioned to deliver cryogenic fluid at a point below said feed junction, the annular space between said outer and second tubes providing said bypass passage.

9. Apparatus as claimed in claim 3, said feed conduit running within said return conduit.

10. Apparatus for delivering cryogenic liquid to a heat exchanger wherein said liquid is vaporized for its cooling effect said apparatus having a separator vessel for holding cryogenic liquid in its lower portion and the vapor of said liquid in its upper portion, said vessel being positioned higher than said exchanger and having a vent for discharge of vapor, a feed conduit with an upper and a lower end for conveying cryogenic liquid from said vessel to an exchanger, said feed conduit being connected at its upper end to said vessel to draw cryogenic liquid from the lower portion thereof, and a delivery port for discharging cryogenic liquid to an exchanger, said delivery port being connected to receive cryogenic liquid from the lower end of said feed conduit, comprising a return conduit with an upper and a lower end for conveying from an exchanger to said separator vessel spent fluid including some vapor, said return conduit discharging at its upper end into said vessel a return port for receiving spent fluid from an exchanger, said return port being connected to discharge said spent fluid into the lower end of said return conduit, said apparatus providing closed loop circulation of cryogenic liquid to a heat exchanger connected to said ports, the driving force for said circulation being supplied by the differential gravity head between cryogenic liquid in said feed conduit and spent fluid in said return conduit said apparatus including a control valve and a check valve connected in series and controlling the flow of cryogenic fluid to said delivery port, said check valve preventing flow from said delivery port back toward said feed junction.

* * * * *